United States Patent [19]

Walter et al.

[11] 3,973,528

[45] Aug. 10, 1976

[54] STYLING APPARATUS FOR HAIR

[75] Inventors: Henry J. Walter, Wilton; William E. Springer, Stratford, both of Conn.

[73] Assignee: Clairol Incorporated, New York, N.Y.

[22] Filed: Feb. 28, 1975

[21] Appl. No.: 554,333

[52] U.S. Cl. ..... 132/11 R; 132/37 R

[51] Int. Cl.[2] ..... A45D 24/00

[58] Field of Search ..... 132/11, 9, 118, 120, 132/37 R

[56] References Cited

UNITED STATES PATENTS

| | | | |
|---|---|---|---|
| 1,282,070 | 10/1918 | Green et al. | 132/118 |
| 1,376,416 | 5/1921 | Forshee | 132/118 |
| 1,673,314 | 6/1928 | Cottle | 132/118 |
| 2,473,227 | 6/1949 | Solomon | 132/120 |

*Primary Examiner*—G.L. McNeill

*Attorney, Agent, or Firm*—George A. Mentis

[57] ABSTRACT

A styling apparatus for treating hair with heat includes a tubular heated mandrel around which hair is wound to be heat treated and rows of bristles extending from the mandrel for tensioning the hair while the hair is wound. The bristles are preferably mounted on a removable attachment which is received in a slot extending along the mandrel. A row of teeth may also extend from the attachment so that the hair may be combed prior or subsequent to heat treatment.

7 Claims, 12 Drawing Figures

STYLING APPARATUS FOR HAIR

BACKGROUND OF THE INVENTION

1 Field of the Invention

This invention relates to apparatus for treating hair and, more particularly, this invention relates to apparatus for treating hair with heat for styling purposes.

2. Technical Considerations and Prior Art

It is a general practice to apply heat to hair in order to straighten the hair, curl it or form waves therein. It is also a general practice to combine some type of heat treating device with a comb, as is disclosed in the following U.S. Pat. Nos.: 1,382,342, 1,518,388, 2,457,621, 2,545,885, 2,600,472, 3,291,141 and 3,731,694.

With the exception of U.S. Pat. Nos. 3,291,141 and 3,731,694, the afore-mentioned patents use heat to aid in combing hair, rather than for curling hair. In U.S. Pat. Nos. 3,291,141 and 3,731,694, the comb is used to assist in curling hair around a heated mandrel. However, the teeth alone cannot supply sufficient tension to the hair to accomplish this, so that in U.S. Pat. No. 3,731,694, an auxiliary clamp is utilized to hold the hair in place.

Also of interest is U.S. Pat. No. 3,173,428, which discloses a plurality of bristles in combination with a heating element. However, in this patent, the bristles are used for brushing the hair, rather than as a device for assisting in winding the hair for waving.

Of additional interest are patents such as U.S. Pat. Nos. 1,370,649 and 2,610,637, which disclose a combination of bristles and teeth mounted on the same unit to form a combination comb and brush. However, in these patents, the bristles are not for the purpose of tensioning hair about a heater.

OBJECTS OF THE INVENTION

It is an object of the instant invention to provide a new and improved apparatus for treating hair with heat.

It is an additional object of the instant invention to provide a new and improved apparatus for treating hair with heat while, at the same time, providing a comb for combing the hair.

It is still another object of the instant invention to provide a new and improved apparatus for treating hair with heat, wherein hair which is thin, fine or short may be readily heat treated to form waves or the like therein.

It is still an additional object of the instant invention to provide a new and improved apparatus for treating hair with heat, wherein the apparatus includes teeth for combing the hair and projecting bristles for tensioning the hair as the hair is wound about a heat treating mandrel.

It is still a further object of the instant invention to provide an apparatus for heat treating the hair, wherein a dry heat is applied to the hair.

It is yet an additional object of the instant invention to provide a new and improved apparatus for treating the hair which is easily manipulated to alternate between combing the hair and heat treating the hair.

SUMMARY OF THE INVENTION

In view of these and other objects, the instant invention contemplates an apparatus for treating the hair which includes means for heating the hair, a row of spaced teeth for combing the hair and at least one row of bristles for selectively engaging the hair to tension the hair into engagement with the heating means.

The instant invention further contemplates a removable attachment having a row of teeth and at least one row of bristles thereon which may be selectively mounted on the heating means.

Other objects and advantages of the afore-summarized instant invention will become apparent from the following description of a preferred embodiment, taken in conjunction with the attached drawings.

DESCRIPTION OF THE PREFERRED EMBODIMENTS

Figure 1:
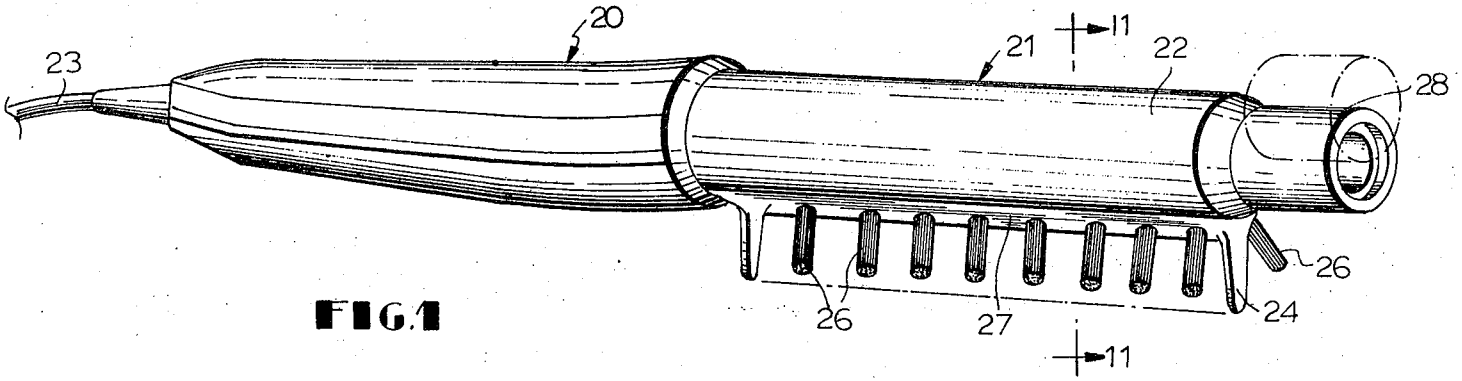
FIG. 1 is a perspective view of a hair treating apparatus in accordance with the present invention.

Referring now to FIG. 1, there is shown an apparatus for treating the hair which includes a handle, generally designated by the numeral 20, and a hair engaging portion, generally designated by the numeral 21, which is attached thereto. The hair engaging portion 21 has a heated mandrel 22 which is energized by a house current passing through a power cord 23. In order to heat treat hair, the hair is wound about the mandrel 22 by turning the handle 20 manually.

Projecting from the mandrel 22 are a row of teeth 24 and two rows of bristle tufts **26*a* and 26*b* which project from the mandrel obliquely with respect to the row of teeth 24. The row of teeth 24 form a comb which is used to comb the hair in an ordinary fashion. However, when it is desired to heat treat the hair, the apparatus is tilted slightly so that the bristle tufts 26 engage the hair and tension the strands thereof so that the hair may be wound around the mandrel 22. By having two rows of bristle tufts 26*a* and 26*b* on opposite sides of the comb 24**, hair may be conveniently rolled in either direction so that the handle may be held in either the left or right hand.

In one preferred embodiment of the instant invention, the teeth 24 and bristle tufts 26 are attached to a base 27 which is removable from the mandrel 22. As will be explained later, a rotating cap 28 selectively secures the base 27 to the mandrel 22.

Figure 2:
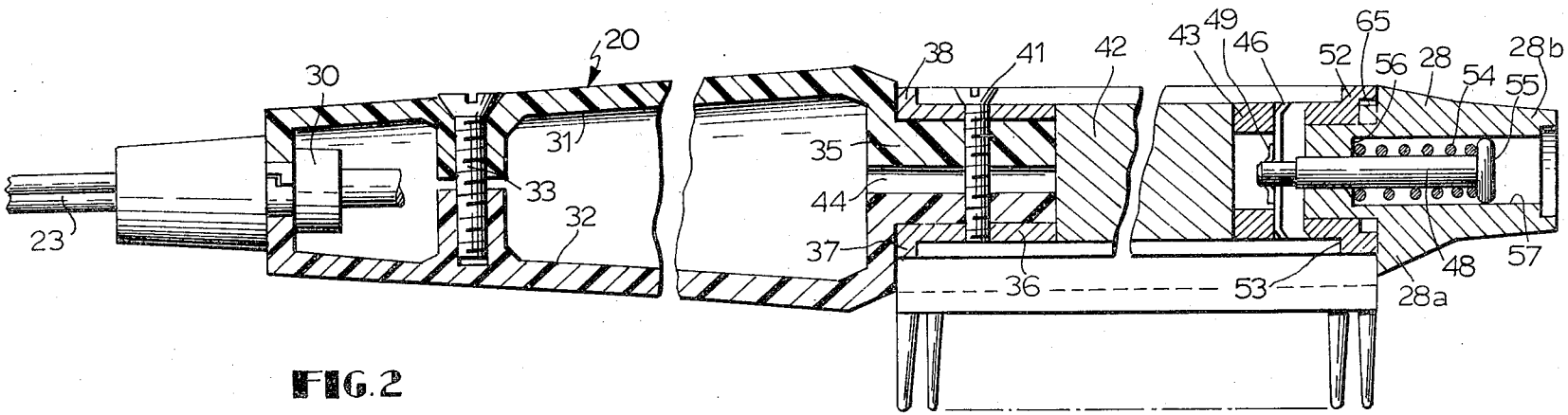
FIG. 2 is a side view in section of the apparatus of FIG. 1 showning the various internal components thereof.

Referring now to FIG. 2, the power cord 23 is shown attached to the handle 20 by a bushing 30 or the like which fits inside of the mandle to prevent the power cord from coming loose. The handle 20 is preferably made of a top shell 31 and a bottom shell 32 which are secured together by a screw 33. A neck 35 projects from the handle 20 and provides support for the hair treating portion 21 of the apparatus. The neck registers with an insulating bushing 36 which surrounds the neck and which has a ring 37 that abuts the end 38 of the housing. The mandrel 22 surrounds the insulating bushing 36 and abuts the ring 37 which holds the mandrel in spaced relation from the handle 20 so that heat from the mandrel 22 will not be conducted to the handle. Another screw 41 passes down through the mandrel 22 and into the neck 35 of the housing to hold the mandrel thereon.

In order to heat the mandrel 22, a conventional thermostat type heater 42 is concentrically contained therein and is held against the insulating bushing 36 by an insulating spacer washer 43. The heater 42 is energized by the line 23 which passes through the handle 20 and through a bore 44 in the neck 35 to connect to the heater.

On the other side of spacer washer 43, a bowed or convex spring clip 46 is inserted into the mandrel 22 and presses the spacer washer 43 against the heater. The spring clip 46 frictionally engages the inside of mandrel 22 so that it cannot be withdrawn therefrom. If an attempt is made to extract the spring clip 46 from within the mandrel 22, the periphery of the spring clip will be urged against the inside surface of the mandrel, thus holding the spring clip in place. The spring clip has a bore therethrough which receives a spindle 48. The spindle 48 has a lock washer 49 therearound which engages the inside surface of the spring clip so that the spindle cannot be withdrawn from the bore. Concentric with spindle 48 is cap 28 which is inserted into an insulating bushing 52 received by the mandrel 22. The insulating bushing 52 has a shoulder 53 thereon which prevents heat from being conducted from the mandrel 22 to the cap 28. The cap 28 is rotatably mounted on the spindle 48 and is held in engagement therewith by a spring 54 which has one end abutting a head 55 on the spindle and the other end abutting the bottom 56 of a bore 57 in the cap within which the spindle is received.

Figure 3:
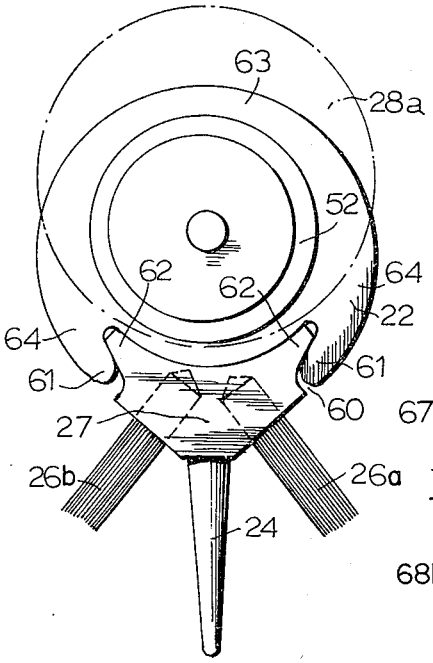
FIG. 3 is a front view in section of the apparatus of FIG. 1 taken along lines 3—3 of FIG. 2 showing how a comb and brush attachment is dovetailed to the apparatus and how an end cap is rotated to lock or release the attachment from the apparatus.

Referring now to FIG. 3, where a cross-section of the mandrel 22 is shown, it is seen that the base 27 is contained within a slot 60 formed in the mandrel 22. The mandrel 22 has a pair of lips 61 which extend over the slot so that the opening of the slot is larger than the bottom of the slot. The base 27 has a pair of projecting wings 62 which fit beneath the lips 61 so that the base 27 slidably dovetails within the slot. In order to remove the base from the slot, it is simply slid out therefrom. In order to accommodate the slot 60, the mandrel 22 has an eccentric configuration, wherein the back side 63 of the mandrel is relatively thin and the front side 64 is relatively thick.

The operation of the cap 28 is perhaps best seen in FIGS. 1, 2 and 3. The cap 28 consists of two circular segments 28*a* and 28*b* which are eccentric to one another. The larger segment 28*a* is the same diameter as the outside of the mandrel 22 while the center of the smaller segment 28*b* is aligned with the bore 44 or the axis of the mandrel 22. The cap 28 rotates about this axis so that the outer periphery of the larger segment 28*a* matches the outside diameter of the mandrel 22 when the cap is rotated so as to cover the slot 60, thereby preventing the base 27 of the attachment from being slid out. When the cap 28 is rotated 180° so that the larger segment 28*a* clears the slot 60, its outer periphery clears the slot, allowing the base of the attachment to be inserted or withdrawn. Preferably, the cap 28 is detented by a detent 65 with the bushing in either the covered or open position with the slot 60.

Figure 4:
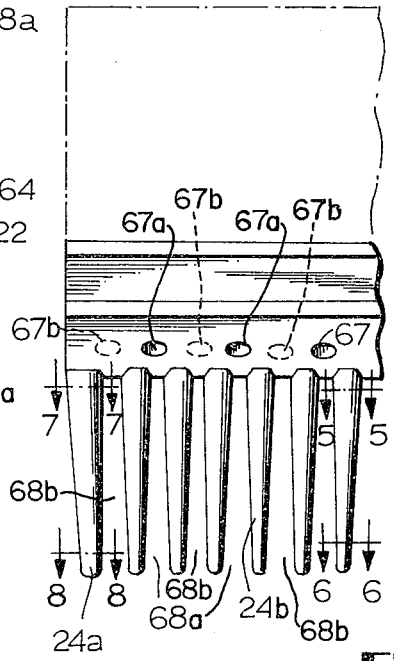
FIG. 4 is an enlarged view of a comb used with the instant invention.
Figure 4:
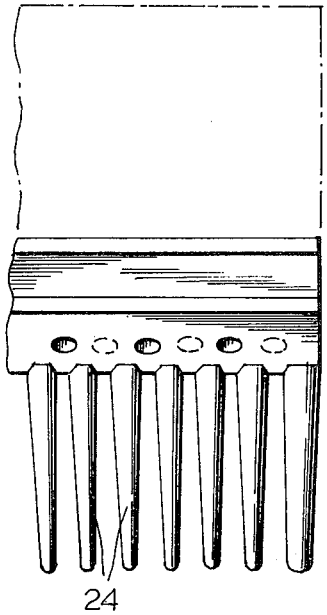
Figure 5:
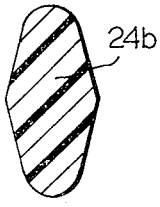
FIGS. 5 and 6 are sections through one of the internal teeth of the comb.
Figure 6:
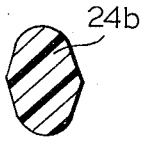
Figure 7:
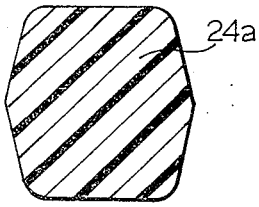
FIGS. 7 and 8 are sections through the end teeth of the comb.
Figure 8:
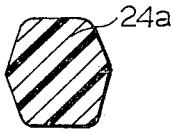

The specific structure of the comb is shown in FIG. 4, wherein it is seen that the outer teeth 24*a* of the comb have relatively thick cross-sections as seen in FIGS. 7 and 8, while the inner teeth 24*b* have relatively thin cross-sections as seen in FIGS. 5 and 6. As seen in FIG. 4, the individual bristle tufts 26*a* are received in holes 67*a* which are aligned with the spaces 68*a* between the teeth 24 while the individual bristle tufts 26*b* are aligned with spaces 68*b*. From this arrangement, it is seen that the tufts 26*a* on one side of the row of teeth 24 are aligned with alternate spaces 68*a*, while the tufts 26*b* on the other side of the row of teeth are aligned with alternate spaces 68*b*, which do not have a tuft 26*a* aligned therewith. This facilitates frictional engagement between the bristle tufts 26*a* and 26*b* and the hair so as to tension the hair when it is desired to wind the hair on mandrel 22.

Figure 9:
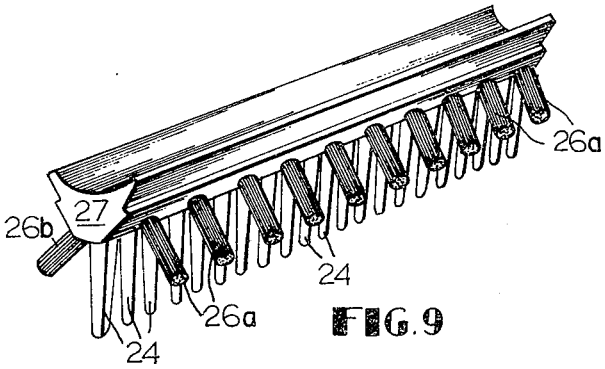
FIG. 9 is a perspective view of an attachment having both teeth to form a comb and bristles.
Figure 10:
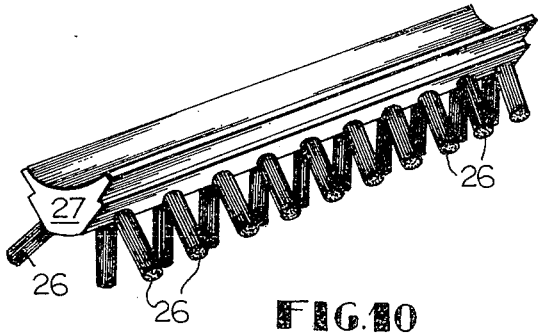
FIG. 10 is a perspective view of an attachment having only bristles.

Referring now to FIGS. 9 and 10, two embodiments of the attachment are shown. In FIG. 9, the attachment utilizes teeth 24 to form a comb, as well as using the bristle tufts 26*a* and 26*b*. In FIG. 10, the teeth 24 have been deleted and only bristles are utilized. When using the attachment of FIG. 9, the hair may be combed in a conventional fashion by holding the handle of the apparatus so that the teeth 24 are substantially normal to the hair being combed. When it is desired to heat treat the hair, the handle 20 is turned so that the bristle tufts 26*a* and 26*b* engage the hair and tension the hair, which enables a person to readily wind the hair around the mandrel 22 and thus heat the hair to form waves.

If it is desired only to wave the hair, the embodiment of FIG. 10 may be utilized, wherein the attachment only has bristle tufts 26*a* and 26*b* projecting therefrom.

Figure 11:
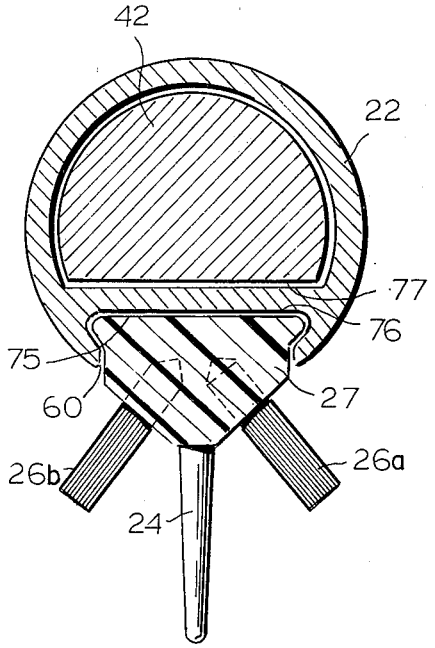
FIG. 11 is a cross-sectional view of another embodiment of the invention taken along lines 11—11 to FIG. 1.
Figure 12:
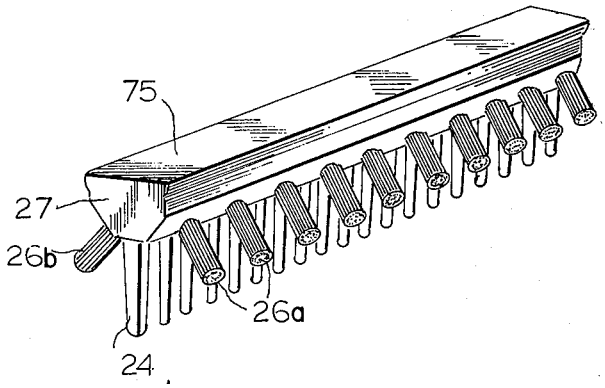
FIG. 12 is another embodiment of an attachment according to the instant invention.

As seen in FIGS. 11 and 12, in order to facilitate manufacture of the styling apparatus 21, the base 27 may have a flat back 75 instead of the concave back illustrated in FIGS. 3, 9 and 10. By having a flat back 75, the slot 60 may have a flat bottom 76 which is easier to machine than the convex bottom of the embodiment of FIG. 3.

In the embodiment of FIG. 11, the heater 42 also has a flat bottom 77 so that the heater 42 is substantially D-shaped in cross-section and complements the back 75 of the base 27.

Inasmuch as the instant invention is subject to many variations, modifications and changes in detail, it is intended that all matter described above and shown in the accompanying drawings be interpreted as illustrative and not as limiting. The scope of the instant invention is to be limited only by the following appended claims.

What is claimed:

1. Apparatus for treating hair, comprising:

a mandrel having first and second ends, a cavity extending therein and a heat treating surface;

handle means secured to the first end of the mandrel;

mounting means disposed along the periphery of the mandrel;

attachment means detachably retained by said mounting means, said attachment means including a base having a row of spaced relatively rigid teeth extending therefrom, and first and second rows of bristle tufts extending along each side of the row of teeth in spaced relation thereto, wherein the tufts of the first row are aligned with every other space between the teeth, and the tufts of the second row are aligned with the alternate spaces between the teeth not having a tuft of the first row aligned therewith; and heating means for supplying heat to the surface of the mandrel to heat treat, said heating means being disposed within said cavity of said mandrel.

2. The hair treating apparatus of claim 1, wherein said mounting means includes:

a slot extending along said mandrel, wherein said slot is defined by spaced flanges beneath which said base is received and from which said teeth and projections extend when said attachment means is mounted on said mandrel.

3. The apparatus of claim 2, wherein said slot means terminates adjacent the second end of said mandrel and wherein cap means overlies the second end of said mandrel and selectively overlies said slot to retain said attachment means selectively in said slot means.

4. The apparatus of claim 3, wherein the cap means is rotatably mounted and has an eccentric configuration so that when rotated, said cap means selectively overlies and clears said slot to allow said attachment to be secured to and removed from said mandrel.

5. The apparatus of claim 1, wherein the row of teeth projects radially with respect to said mandrel and wherein the bristles project obliquely with respect to said teeth so that when the apparatus is oriented so that the bristles engage the hair, the hair will be tensioned across the heated surface of the mandrel.

6. A hand-held apparatus for treating hair, including:

a tubular mandrel of metallic material having a hair treating surface theron, said mandrel having an eccentric configuration relative to a longitudinal axis and having a thickness which increases from one side thereof to the other;

a slot extending longitudinally in the thickest portion of the mandrel to define a female portion of a dovetail mounting;

a hair engaging attachment devetailed in said slot, said hair engaging attachment including one row of teeth and two rows of bristles projecting obliquely, with respect to said teeth and disposed on opposite sides of the row of teeth for tensioning hair as the bristles are applied against the hair; and means within said mandrel for heating said mandrel so that hair tensioned by said bristles and urged aginst the surface of said mandrel is heat treated to form waves therein.

7. The apparatus of claim 6, wherein the mandrel has a handle projecting from one end and a locking cap for holding the attachment in the slot extending from the other end.

* * * * *